US008276301B2

(12) United States Patent
Lee et al.

(10) Patent No.: US 8,276,301 B2
(45) Date of Patent: Oct. 2, 2012

(54) LINK TYPE PERCUSSION LOCK

(75) Inventors: Joon-Ho Lee, Yongpo-ri (KR); Eui-Jung Choe, Daejeon (KR); Je-Wook Chae, Daejeon (KR); Hyun-Jun Kim, Seoul (KR)

(73) Assignee: Agency for Defense Development, Yuseong-gu, Daejeon-si (KR)

( * ) Notice: Subject to any disclaimer, the term of this patent is extended or adjusted under 35 U.S.C. 154(b) by 103 days.

(21) Appl. No.: 13/003,698

(22) PCT Filed: Jul. 13, 2009

(86) PCT No.: PCT/KR2009/003824
§ 371 (c)(1),
(2), (4) Date: Jan. 11, 2011

(87) PCT Pub. No.: WO2010/008163
PCT Pub. Date: Jan. 21, 2010

(65) Prior Publication Data

US 2011/0107641 A1 May 12, 2011

(30) Foreign Application Priority Data

Jul. 18, 2008 (KR) ..... 10-2008-0070091

(51) Int. Cl.
*F41A 19/00* (2006.01)

(52) U.S. Cl. ..... 42/69.01; 89/27.11

(58) Field of Classification Search ..... 42/69.01, 42/69.02; 89/27.11, 27.3
See application file for complete search history.

(56) References Cited

U.S. PATENT DOCUMENTS

| | | | | |
|---|---|---|---|---|
| 4,452,001 | A * | 6/1984 | Compton | 42/23 |
| 4,472,899 | A * | 9/1984 | Joelsson et al. | 42/42.01 |
| 4,551,936 | A * | 11/1985 | Chauvet | 42/42.01 |
| 4,648,190 | A * | 3/1987 | Allen | 42/23 |
| 5,465,518 | A * | 11/1995 | Blaser | 42/70.08 |
| 5,570,527 | A * | 11/1996 | Felicci | 42/70.08 |
| 7,086,191 | B2 * | 8/2006 | Orr | 42/69.01 |
| 2004/0237371 | A1 * | 12/2004 | Orr | 42/69.02 |
| 2011/0107641 | A1 * | 5/2011 | Lee et al. | 42/69.01 |

OTHER PUBLICATIONS

Martin, George H., Kinematics and Dynamics of Machines, 1982, Chapter 3 "Linkage", Second Edition, McGraw-Hill, New York.

* cited by examiner

*Primary Examiner* — Michelle Clement
(74) *Attorney, Agent, or Firm* — Cahn & Samuels, LLP

(57) ABSTRACT

Disclosed is a percussion lock installed on a firearm, and more particularly, to a percussion lock wherein the hammer is operated through a link member so that operation of the firearm is possible in a small area, making it possible to design a firearm flexibly and reducing the volume and weight of the firearm. According to the present invention, the percussion lock installed on a firearm to fire a bullet by hitting a firing pin comprises a housing mounted in fixed state to a firearm, a hammer installed on the upper part of the housing for hitting a firing pin, a link member linking the hammer and the housing so that the hammer moves on a curve maintaining horizontal state, and an elastic member supporting the link member with elastic force.

7 Claims, 1 Drawing Sheet

[Fig. 1]
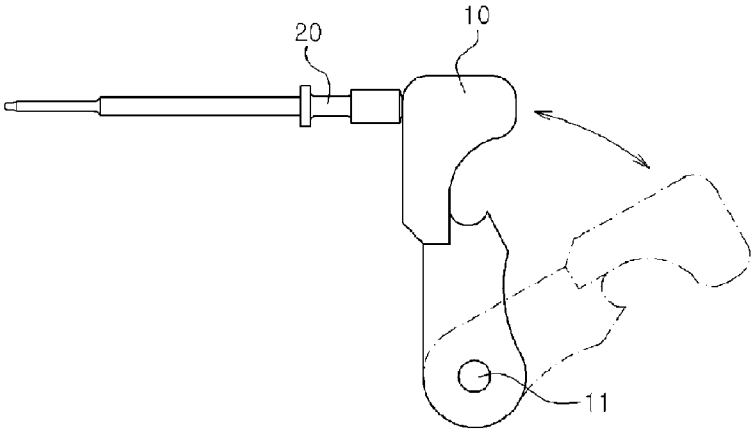
[Fig. 2]
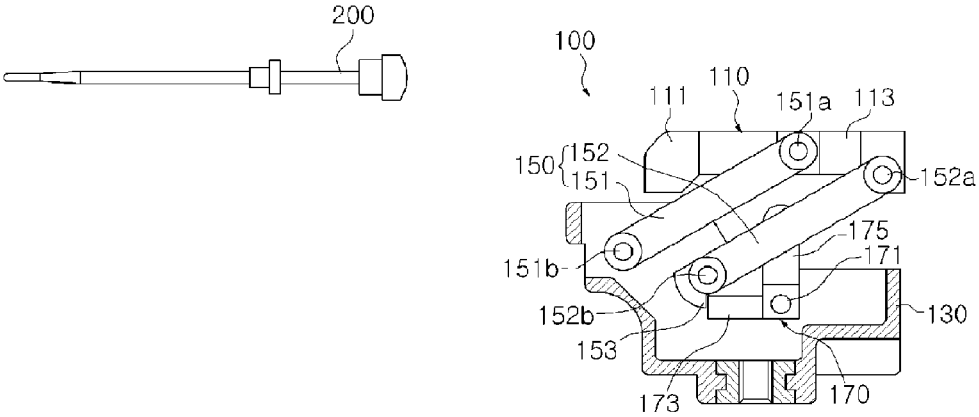
[Fig. 3]
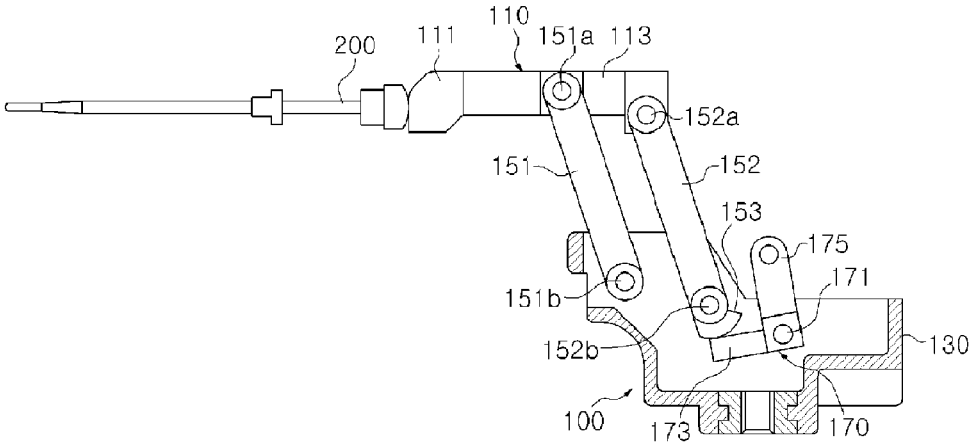

LINK TYPE PERCUSSION LOCK

This application is the National Stage of International Application No. PCT/KR2009/003824, filed on Jul. 13, 2009, was published in the English language on Jan. 21, 2010, and claims priority to Korean Patent Application No. 10-2008-0070091 filed on Jul. 18, 2008. The entire contents of both applications are incorporated herein by reference for all purposes.

TECHNICAL FIELD

The present invention relates to a percussion lock installed on a firearm, and more particularly, to a percussion lock wherein the hammer is operated through a link member so that operation of the firearm is possible in a small area, making it possible to design a firearm flexibly and reducing the volume and weight of the firearm.

BACKGROUND ART

Firearms are devices which project either single or multiple projectiles through a controlled explosion of explosive powder built in the bullets. Firearms are classified into small arms and heavy weapons. Small arms such as rifles or handguns use small size bullets and have a size that is appropriate for an individual to carry and operate. Heavy weapons such as mortars or recoilless guns use relatively larger bullets compared to small arms and have a large size that can be operated by a group of staffs.

Most of the firearms use a bullet that has a built-in percussion cap in the rear end of the bullet, which is ignited by the percussion. When a percussion lock installed in the firearm gives a firing pin an impact, percussion is given to the percussion cap through the firing pin thereby igniting the gunpowder in the bullet by the percussion cap and firing the head of the bullet.

The percussion lock hits the firing pin by using the elastic force of a spring, and plays a key role in the construction of the firearm since a bullet is fired when the operator of the firearm pulls the trigger which is connected to the percussion lock.

A percussion lock of a rifle is illustrated in FIG. 1 as an example of prior art percussion lock.

The conventional percussion lock is constructed inside the firearm and comprises a hammer 10 which is located at the rear side of the firing pin 20 with predetermined length and formed to hit the firing pin 20, and a spring (not illustrated) supporting the hammer 10 through elastic force, a hinge 11 being formed at the lower end of the hammer 10 so that the hammer 10 can rotate.

According to the construction of the conventional percussion lock, the hammer 10 is rotated, at the time of firing, to the opposite direction of the firing pin 20 thereby compressing the spring which supports the hammer 10 through elastic force of the spring, and, as the operator pulls the trigger, the compressed spring returns to the original state and the hammer 10 hits the firing pin 20 thereby firing the bullet.

In the conventional percussion lock, however, the hammer 10 moves in rotary motion and when the firing pin 20 is located remote from the hammer 10, the length of the hammer 10 should be extended, thereby making the radius of rotation longer. So designing the firearm is limited and the volume and weight of the firearm increase, making it difficult to manufacture smaller firearms.

DISCLOSURE OF INVENTION

Technical Problem

The present invention has been designed to solve the problems of the conventional percussion lock by linking the hammer of the percussion lock by a link member so that the hammer moves on a curve maintaining horizontal state, making it possible to design a firearm flexibly and reducing the volume and weight of the firearm.

Technical Solution

In order to solve the problem of prior art percussion lock, the percussion lock of the present invention which is installed on a firearm to fire a bullet by hitting a firing pin, which comprises a housing mounted in fixed state to a firearm, a hammer installed on the upper part of the housing for hitting a firing pin, a link member linking the hammer and the housing so that the hammer moves on a curve maintaining horizontal state, and an elastic member supporting the link member with elastic force.

Also, in the percussion lock of the present invention, a buckling latch is formed on the link member and a sear is constructed to be engaged to the buckling latch to limit the movement of the link member.

Also, in the percussion lock of the present invention, the link member comprises a first link and a second link which are arranged in parallel with predetermined distance.

Also, in the percussion lock of the present invention, the sear comprises a hinge rotatably connected to the housing, a latching part which is formed extruding to one side of the hinge to be engaged to the buckling latch, and a trigger connecting part which is formed extruding to the outer side of the housing with predetermined length in perpendicular with the latching part.

Also, in the percussion lock of the present invention, one end of the first link is rotatably connected to the middle of the body of the hammer through a first hinge, and the other end is rotatably connected to the housing through a second hinge.

Also, in the percussion lock of the present invention, the second link is constructed so that one end of the link is connected to the outer end of the body of the hammer through a first hinge and the other end is rotatably connected to the housing through a second hinge, where a buckling latch is formed extruding from the outer surface of the second hinge.

Advantageous Effects

By using the percussion lock of the present invention, there is the advantage compared to the prior art apparatus in that the firing pin can be hit in a small space when the percussion lock is distant, and so the design of a firearm is flexible and the volume and weight of the firearm can be reduced.

BRIEF DESCRIPTION OF DRAWINGS

FIG. 1 shows the side view of the percussion lock of conventional rifles.

FIG. 2 is a side view of the percussion lock of the example of the present invention.

FIG. 3 illustrates the operation status of the percussion lock of FIG. 2.

DESCRIPTION OF NUMERALS IN THE DRAWINGS

100: percussion lock
110: hammer

111: head part of hammer
113: body of hammer
130: housing
150: connecting member
151: first link
152: second link
151*a*, 152*a*: first hinge
151*b*, 152*b*: second hinge
170: sear
171: hinge
173: latching part
175: trigger connecting part
200: firing pin

BEST MODE FOR CARRYING OUT THE INVENTION

The present invention will be described in more detail with reference to the attached drawings.

FIG. 2 is a side view of the percussion lock of the present invention, and FIG. 3 illustrates the operation status of the percussion lock of FIG. 2.

As shown in FIGS. 2 and 3, the percussion lock 100 according to the example of the present invention comprises a housing 130 mounted in fixed state to a firearm, a hammer 110 for hitting a firing pin 200, a link member 150 linking the hammer 110 and the housing 130, and an elastic member (not illustrated) supporting the link member 150 with elastic force.

The housing 130 is combined or mounted in the firearm installing the percussion lock 100 in fixed state to the firearm.

The hammer 110 is located on the upper part of the housing 130 and comprises a head part 111 which hits the firing pin 200, and a body part 113 which is formed extruding horizontally from the head with predetermined length. The hammer is formed to have enough weight to transfer enough force to the firing pin 200 when hitting the firing pin 200.

The link member 150 is formed with predetermined length to link the housing 130 and the hammer 110, and one end is connected to the housing 130 and the other end to the hammer 110, each end being rotatably connected so that the hammer 110 can move a rotary motion maintaining horizontal state.

The link member 150 preferably comprises a first link 151 and a second link 152, each link having the same length and being arranged in parallel in the longitudinal direction. Preferably, one end of the first link 151 is rotatably connected to the middle of the body 113 of the hammer 110 through a first hinge 151*a*, and the other end is rotatably connected to the side wall of the housing 130 through a second hinge 151*b*. As the distance between the first hinge 151*a* and the head 111 of the hammer 110 becomes longer, the hammer can hit the firing pin 200 at a longer distance.

Also the second link 152 is arranged in parallel with the first link 151, and one end of the link is rotatably connected to the outer side end of the body 113 of the hammer 110 through a first hinge 152*a*, and the other end is rotatably connected to the side wall of the housing 130 through a second hinge 152*b*.

The hinges 151*a*, 151*b*, 152*a*, 152*b* connecting the components are preferably in the shape of a pin and connected to the components in which holes are formed so that the hinges 151*a*, 151*b*, 152*a*, 152*b* can be inserted. It is also possible to construct the hinge and the component in a body without separately constructing hinges 151*a*, 151*b*, 152*a*, 152*b*.

The elastic member (not illustrated) is constructed for the hammer 110 to hit the firing pin 200 through elastic force. Preferably, the elastic member (not illustrated) is a twisting coil spring, and one end of the elastic member is fixed on the first link 151 and the other end is fixed to the housing 130 so that the twisted coil spring is compressed when the hammer 110 is moved to the direction opposite to the firing pin 200.

Also, in the percussion lock 100, a buckling latch is formed on the link member 150 and a sear 170 is installed engaging to the buckling latch to limit the operation of the percussion lock 100. The buckling latch 153 is preferably formed extruding from the outer side end of the second link 152 where the second hinge 152*b* is installed, and the sear 170 is preferably constructed to be engaged to the buckling latch 153 when the hammer 110 is maximally rotated to the opposite direction of the firing pin 200 in the percussion lock 100.

The sear 170 is installed in the housing 130 to be rotatable around the hinge 171, and preferably comprises a latching part 173 which is formed extruding to one side of the hinge 171 to be engaged to the buckling latch 153, and a trigger connecting part 175 which is formed extruding to the outer side of the housing 130 with predetermined length in perpendicular with the latching part 173. The sear 170 is constructed so that the latching part 173 is engaged to the buckling latch 153 through elastic force of the elastic member (not illustrated). Also, the elastic member is preferably constructed so that one end of the twisted coil spring is fixed on the housing 130 and the other end to the sear 170.

Now, the operation and effect of the above construction will be described.

The percussion lock 100 of the present invention is constructed so that the hammer 110 and the first and second link 151, 152 which are arranged in parallel on the housing 130 are rotatably connected through the hinges 151*a*, 151*b*, 152*a*, 152*b*, the hammer 110 moves along a curve in the firearm maintaining its horizontal state, and the first link 151 is supported in the direction of the firing pin 200 through the elastic force of the twisted coil spring. Also, a buckling latch 153 is formed on the second link 152 which is installed in parallel with the first link 151 so that the latching part 173 of the sear 170 is supported by the twisted coil spring to be engaged in the buckling latch 153.

In order to fire a bullet using a firearm equipped with the percussion lock 100, a bullet is inserted in the firearm so that the firing pin 200 can hit the percussion cap of the bullet, and the hammer 110 is moved to the opposite direction of the firing pin 200. At this stage, the first link 151 and the second link 152 which are connected to the hammer 110 rotate to the same direction as the moving direction of the hammer 110, and the first link 151 compresses the twisted coil spring and the second link 152 is fixed to the state where the hammer 110 is retreated, the buckling latch 153 being engaged to the latching part 173 of the sear 170.

Then, when an operator operates the trigger (not shown), the sear 170 which is connected to the trigger rotates around the hinge 171, the latching part 173 is released from the buckling latch 153 and the first link 151 rotates to the direction of the firing pin 200 by the restoring force of the compressed twisted coil spring.

By the rotating force of the first link 151, the hammer 110 which is connected to the first link 151 rotates to the direction of the firing pin 200, and the second link 152 supports the outer side end of the body 113 of the rotating hammer 110, and the hammer hits the firing pin 200 maintaining its horizontal state, and the bullet is fired.

Therefore, the percussion lock of the present invention has the advantage compared to the prior art apparatus in that the firing pin can be hit in a small space when the percussion lock is distant, and so the design of a firearm is flexible and the volume and weight of the firearm can be reduced.

Although preferable example of the present invention has been described, the example is not meant to limit the scope of the present invention and those skilled in the art may modify the invention within the scope descried in the claims of the present invention.

The invention claimed is:

1. A percussion lock installed on firearm to fire a bullet by hitting a firing pin, which comprises a housing (130) mounted in fixed state to a firearm;

a hammer (110) installed on the upper part of the housing (130) for hitting a firing pin;

a link member (150) linking the hammer (110) and the housing (130) so that the hammer (110) moves on a curve maintaining horizontal state; and an elastic member supporting the link member (150) with elastic force.

2. The percussion lock of claim 1, wherein a buckling latch (153) is formed on the link member (150) and a sear (170) is constructed to be engaged to the buckling latch (153) to limit the movement of the link member (150).

3. The percussion lock of claim 1, wherein the link member (150) comprises a first link (151) and a second link (152) which are arranged in parallel with predetermined distance.

4. The percussion lock of claim 2, wherein the sear (170) comprises:

a hinge (171) rotatably connected to the housing (130);

a latching part (173) which is formed extruding to one side of the hinge (171) to be engaged to the buckling latch (153); and a trigger connecting part (175) which is formed extruding to the outer side of the housing (130) with predetermined length in perpendicular with the latching part (173).

5. The percussion lock of claim 3, wherein one end of the first link (151) is rotatably connected to the middle of the body (113) of the hammer (110) through a first hinge (151*a*), and the other end is rotatably connected to the housing (130) through a second hinge (151 *b*).

6. The percussion lock of claim 3, wherein the second link (152) is constructed so that one end of the link is connected to the outer end of the body (113) of the hammer (110) through a first hinge (152*a*) and the other end is rotatably connected to the housing (130) through a second hinge (152*b*), with a buckling latch (153) is formed extruding from the outer surface of the second hinge (152*b*).

7. The percussion lock of claim 2, wherein the link member (150) comprises a first link (151) and a second link (152) which are arranged in parallel with predetermined distance.

* * * * *